US011097825B2

(12) United States Patent
Mizutani et al.

(10) Patent No.: US 11,097,825 B2
(45) Date of Patent: Aug. 24, 2021

(54) SYSTEM FOR MANEUVERING BOAT

(71) Applicant: YAMAHA HATSUDOKI KABUSHIKI KAISHA, Iwata (JP)

(72) Inventors: Makoto Mizutani, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/812,473

(22) Filed: Mar. 9, 2020

(65) Prior Publication Data

US 2020/0307753 A1 Oct. 1, 2020

(30) Foreign Application Priority Data

Apr. 1, 2019 (JP) ..... JP2019-069923

(51) Int. Cl.
*B63H 20/12* (2006.01)
*B63H 20/00* (2006.01)

(52) U.S. Cl.
CPC ..... *B63H 20/12* (2013.01); *B63H 20/001* (2013.01)

(58) Field of Classification Search
CPC ..... B63H 20/12; B63H 20/001
See application file for complete search history.

(56) References Cited

U.S. PATENT DOCUMENTS

| | | | | |
|---|---|---|---|---|
| 7,311,571 | B1 | 12/2007 | Swan et al. | |
| 7,736,206 | B1 * | 6/2010 | McChesney | B63H 20/08 440/61 T |
| 8,133,084 | B2 * | 3/2012 | Murai | B63H 21/265 440/61 S |
| 9,499,247 | B1 | 11/2016 | Wiatrowski et al. | |
| 2003/0200909 | A1 | 10/2003 | Ferguson | |

* cited by examiner

*Primary Examiner* — Stephen P Avila
(74) *Attorney, Agent, or Firm* — Keating and Bennett, LLP

(57) ABSTRACT

A system for maneuvering a boat including a hull and an outboard motor includes a left tilt shaft, a right tilt shaft, a steering shaft support, and a hydraulic cylinder. At least a portion of the hydraulic cylinder is between the left tilt shaft and the right tilt shaft. The hydraulic cylinder exerts a steering force on the outboard motor to rotate the outboard motor about a steering shaft. A hydraulic pump supplies hydraulic fluid to the hydraulic cylinder. One of the left tilt shaft and the right tilt shaft includes a first hole. A portion of the stroke range of the hydraulic cylinder is located within the first hole.

12 Claims, 11 Drawing Sheets

SYSTEM FOR MANEUVERING BOAT

CROSS REFERENCE TO RELATED APPLICATIONS

This application claims the benefit of priority to Japanese Patent Application No. 2019-069923 filed on Apr. 1, 2019. The entire contents of this application are hereby incorporated herein by reference.

BACKGROUND OF THE INVENTION

1. Field of the Invention

The present disclosure relates to a system for maneuvering a boat.

2. Description of the Related Art

Conventional systems for maneuvering a boat include a first bracket, a second bracket, and a cylinder. See for example U.S. Pat. No. 7,311,571. The first bracket is mounted to the hull. The second bracket includes left and right tilt shafts and a steering shaft. The second bracket is rotatably supported on the right and left tilt shafts with respect to the first bracket. The second bracket supports the outboard motor rotatably about the steering shaft. The cylinder exerts a steering force on the outboard motor to rotate the outboard motor about the steering shaft. The cylinder is disposed above the right and left tilt shafts.

In the conventional system for maneuvering a boat described above, the cylinder is arranged above the tilt shaft. Therefore, the system for maneuvering the boat is increased in size as compared with the case where the cylinders are disposed between the left and right tilt shafts. However, when the cylinder is disposed between the right and left tilt shafts, the stroke range of the cylinder is reduced. Alternatively, in order to maintain the stroke range of the cylinder, the distance between the right and left tilt shafts becomes large, and the bracket becomes large.

SUMMARY OF THE INVENTION

Preferred embodiments of the present disclosure secure a large stroke range of a cylinder while downsizing a system for maneuvering a boat.

A preferred embodiment of the present invention provides a hull and an outboard motor attached to the hull, and a system for maneuvering a boat including a first bracket, a second bracket, a hydraulic cylinder, and a hydraulic pump. The first bracket is mounted to the hull. The second bracket includes a left tilt shaft, a right tilt shaft, and a steering shaft support. The second bracket supports the outboard motor at the steering shaft support. The second bracket is rotatably supported with respect to the first bracket at the left tilt shaft and the right tilt shaft. At least a portion of the hydraulic cylinder is disposed between the left tilt shaft and the right tilt shaft. The hydraulic cylinder exerts a steering force on the outboard motor to rotate the outboard motor about the steering shaft support. The hydraulic pump supplies hydraulic fluid to the hydraulic cylinder. One of the left tilt shaft and the right tilt shaft includes a first hole. A portion of the stroke range of the hydraulic cylinder is located within the first hole.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
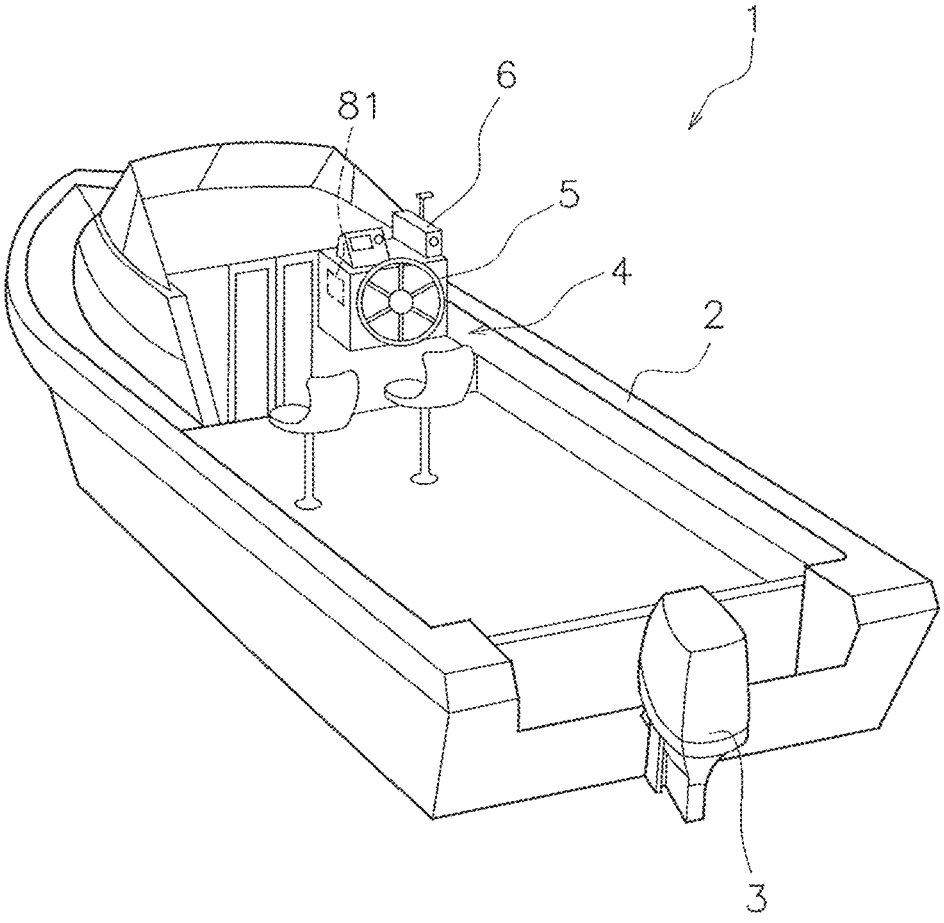
FIG. 1 is a perspective view showing a boat on which a system for maneuvering a boat according to a preferred embodiment of the present invention is mounted.

Hereinafter, preferred embodiments will be described with reference to the drawings. FIG. 1 is a perspective view showing a boat 1 on which a system for maneuvering a boat according to a preferred embodiment is mounted. The boat 1 includes a hull 2 and an outboard motor 3. The outboard motor 3 is attached to the stern of the hull 2. The outboard motor 3 generates a propulsion force to propel the boat 1. In the present preferred embodiment, the number of outboard motors 3 is one, but two or more outboard motors may be mounted on the boat 1.

The boat 1 includes a maneuvering seat 4. A steering member 5 and a remote control device 6 are disposed at the maneuvering seat 4. The steering member 5 enables the operator to turn the boat 1. The steering member 5 is, for example, a steering wheel. However, the steering member 5 may be a lever or another member such as a switch. The remote control device 6 enables the operator to adjust the boat speed. The remote control device 6 enables the operator to switch between forward and reverse of the boat 1.

Figure 2:
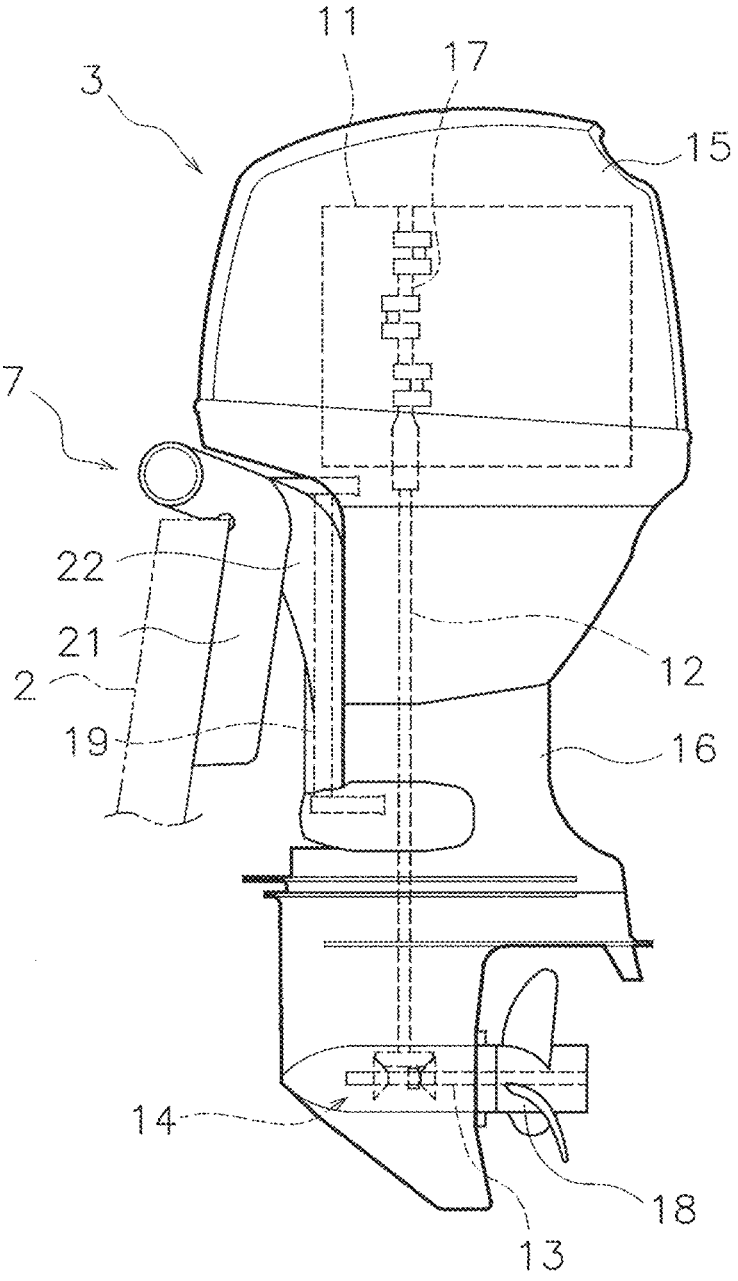
FIG. 2 is a side view showing an outboard motor and the system for maneuvering a boat.

FIG. 2 is a side view showing the outboard motor 3 and the system 7 for maneuvering the boat. As shown in FIG. 2, the outboard motor 3 includes an engine 11, a drive shaft 12, a propeller shaft 13, a shift mechanism 14, an engine cover 15, and a housing 16. The engine 11 generates a propulsive force to propel the hull 2. The engine 11 is disposed in the engine cover 15. The engine 11 includes a crankshaft 17. The crankshaft 17 extends in a vertical direction of the outboard motor 3. The drive shaft 12 is connected to the crankshaft 17. The drive shaft 12 extends in the vertical direction of the outboard motor 3.

The propeller shaft 13 extends in the front-rear direction of the outboard motor 3. The propeller shaft 13 is connected to the drive shaft 12 via a shift mechanism 14. A propeller 18 is connected to the propeller shaft 13. The housing 16 is located below the engine cover 15. The drive shaft 12, the propeller shaft 13 and the shift mechanism 14 are disposed in a housing 16. The shift mechanism 14 switches the rotation direction of the power transmitted from the drive shaft 12 to the propeller shaft 13 between the forward direction and the reverse direction. The shift mechanism 14 includes a plurality of gears and a clutch to change the meshing of the gears.

Figure 3:
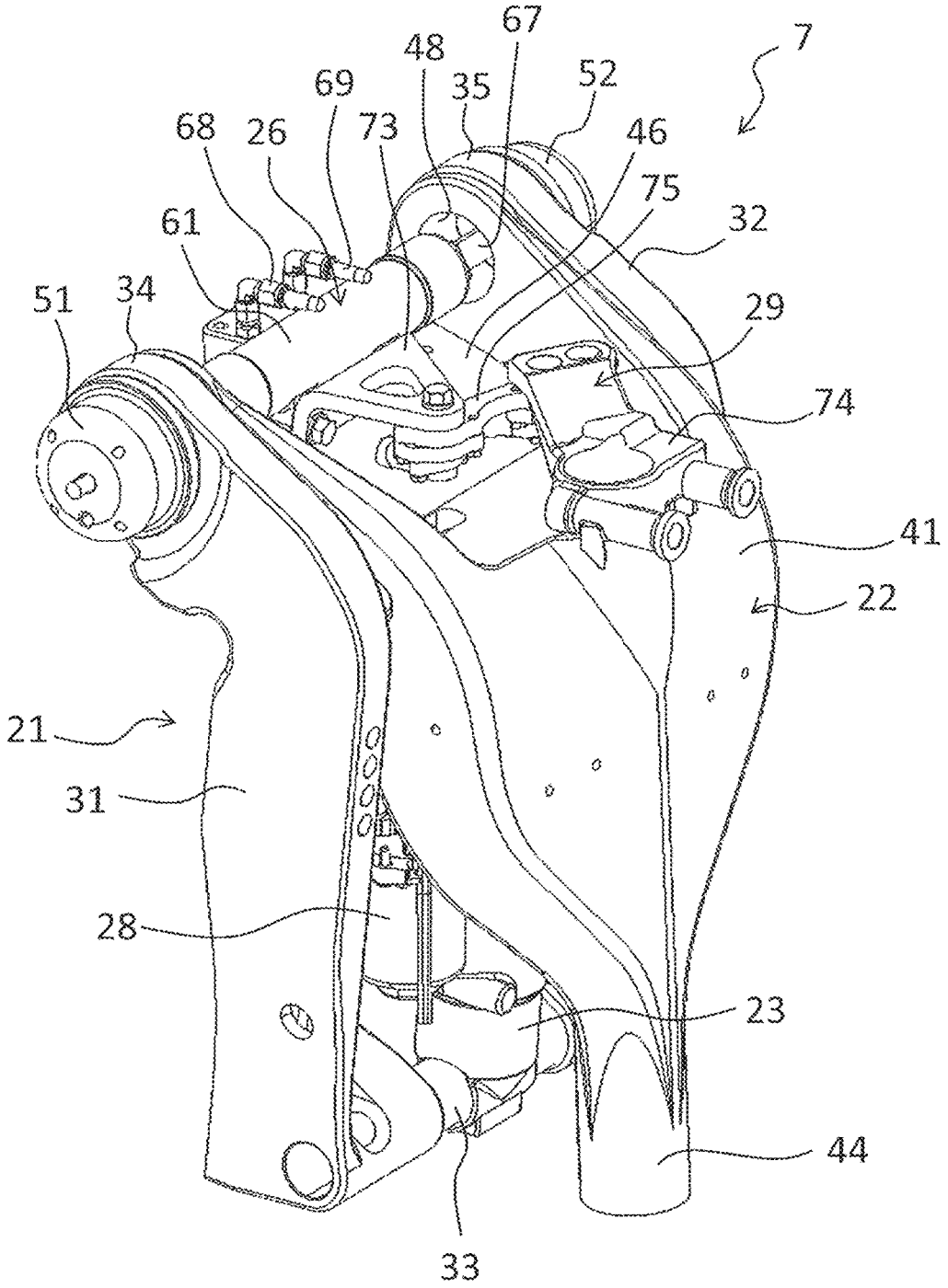
FIG. 3 is a perspective view of the system for maneuvering a boat.
Figure 4:
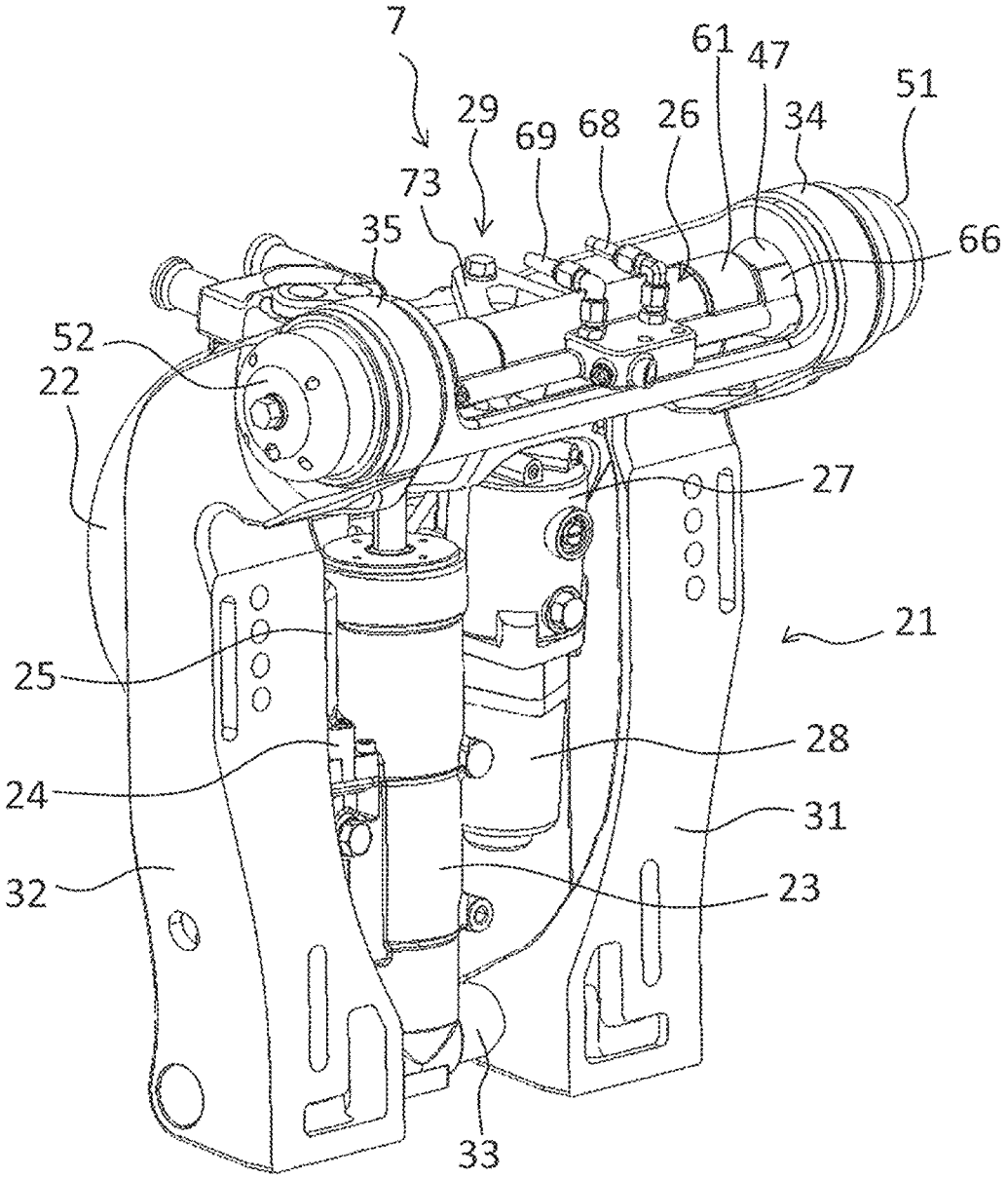
FIG. 4 is a perspective view of the system for maneuvering a boat.
Figure 5:
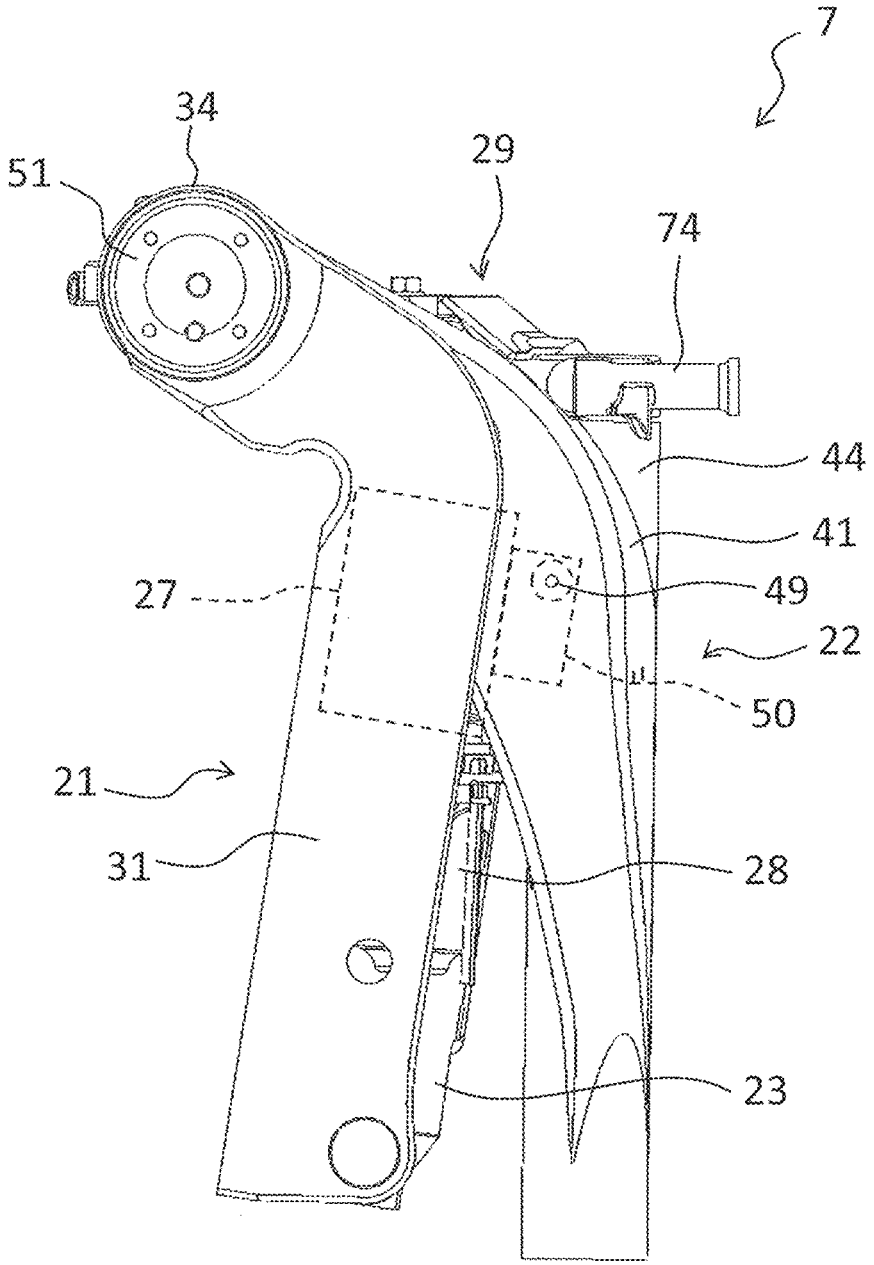
FIG. 5 is a side view of the system for maneuvering a boat.

FIG. 3 and FIG. 4 are perspective views of the system 7. FIG. 5 is a side view of the system 7. As shown in FIGS. 3 to 5, the system 7 includes a first bracket 21, a second bracket 22, a tilt cylinder 23, a tilt pump 24, a tilt motor 25, a steering cylinder 26, a steering pump 27, a steering motor 28, and a linkage 29.

As shown in FIG. 2, the outboard motor 3 is mounted to the hull 2 via a first bracket 21 and a second bracket 22. The first bracket 21 is mounted to the hull 2. As shown in FIGS. 3 to 5, the first bracket 21 includes a left bracket 31, a right bracket 32, and a connector 33.

The upper portion of the left bracket 31 is bent toward the front. The right bracket 32 has the same shape as the left bracket 31. The left bracket 31 includes a left shaft support 34. The right bracket 32 includes a right shaft support 35. The left shaft support 34 and the right shaft support 35 are spaced apart from each other in the left-right direction. The connector 33 extends in the left-right direction. The connector 33 connects the lower portion of the left bracket 31 and the lower portion of the right bracket 32.

Figure 6:
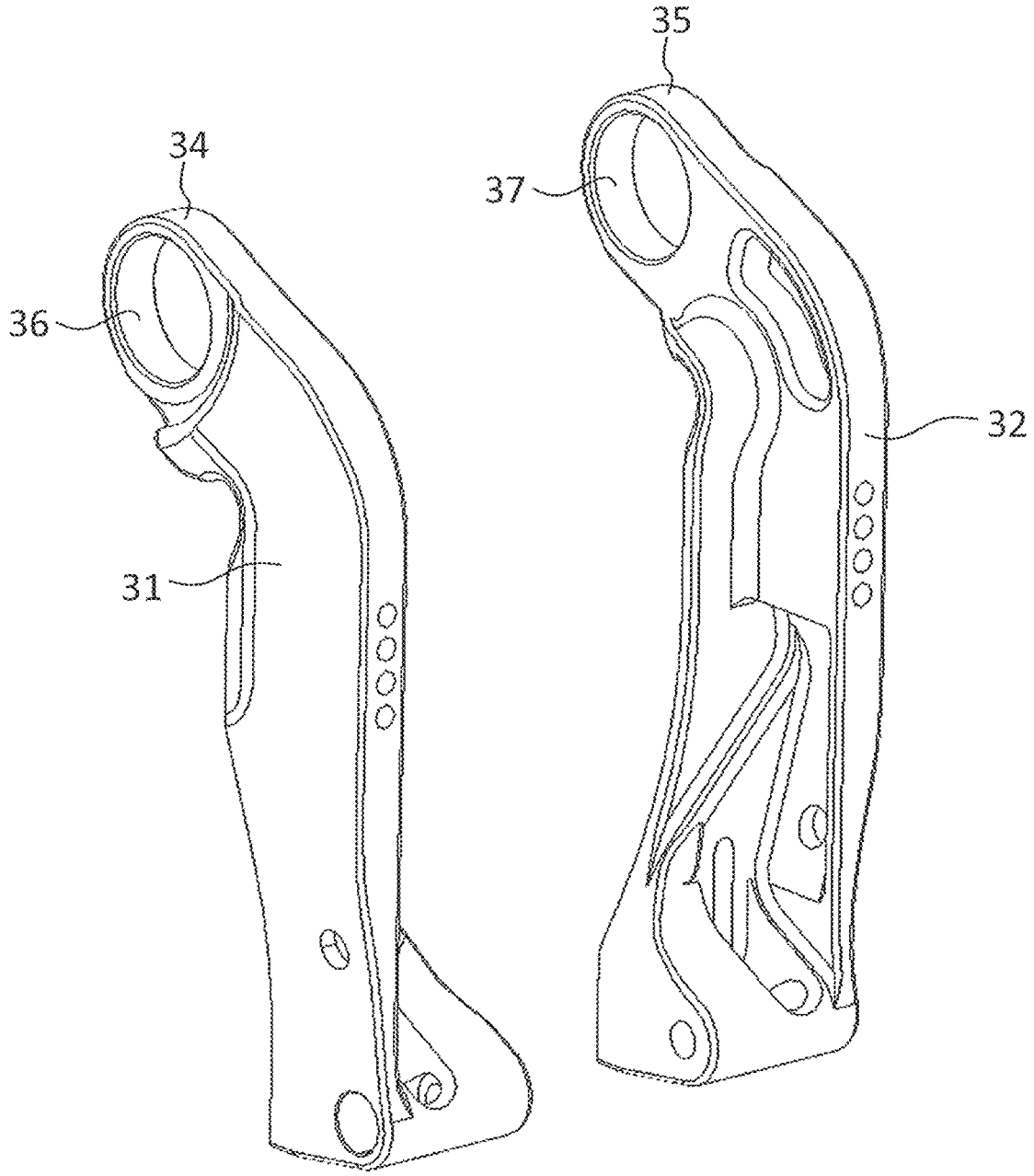
FIG. 6 is a perspective view of a left bracket and a right bracket.

FIG. 6 is a perspective view of the left bracket 31 and the right bracket 32. As shown in FIG. 6, the left shaft support 34 includes a left support hole 36. The left support hole 36 penetrates the left shaft support 34 in the left-right direction. The right shaft support 35 includes a right support hole 37. The right support hole 37 penetrates the right shaft support 35 in the left-right direction.

Figure 7:
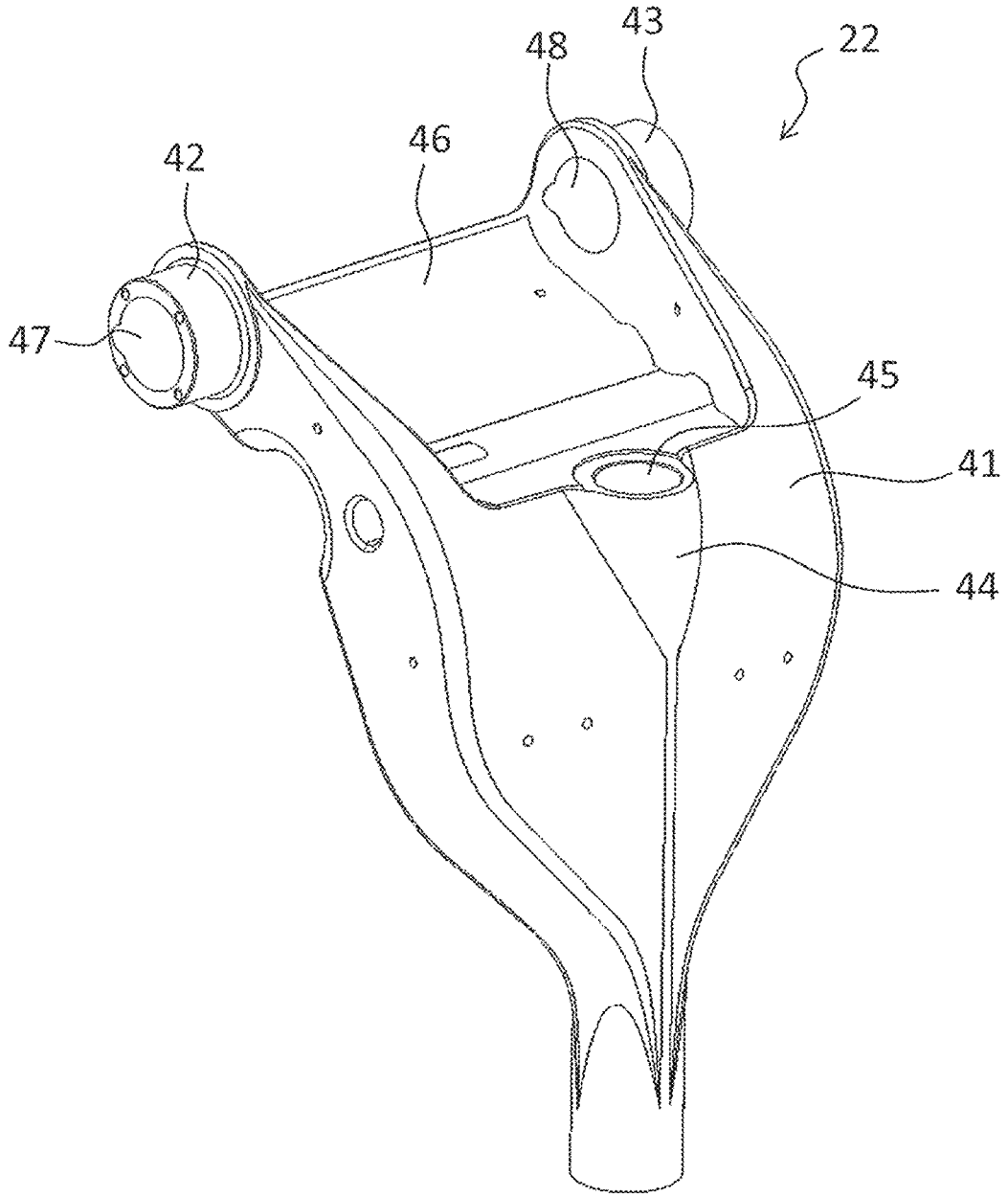
FIG. 7 is a perspective view of the second bracket.

FIG. 7 is a perspective view of the second bracket 22. As shown in FIG. 7, the second bracket 22 includes a bracket body 41, a left tilt shaft 42, a right tilt shaft 43, and a steering shaft support 44. The bracket body 41 connects the left tilt shaft 42, the right tilt shaft 43, and the steering shaft support 44. The bracket body 41 includes a recess 46. The recess 46 is recessed downward from the upper surface of the bracket body 41. The recess 46 is located between the left tilt shaft 42 and the right tilt shaft 43 in the left-right direction.

The steering shaft support 44 includes a support hole 45 extending in the vertical direction. The steering shaft 19 shown in FIG. 2 is inserted into the support hole 45 of the steering shaft support 44. The steering shaft support 44 rotatably supports the steering shaft 19. The steering shaft support 44 supports the outboard motor 3 via the steering shaft 19.

The left tilt shaft 42 and the right tilt shaft 43 are spaced apart from each other in the left-right direction. The left tilt shaft 42 protrudes leftward from the bracket body 41. The left tilt shaft 42 is inserted into the left support hole 36 of the left shaft support 34. The left tilt shaft 42 is rotatably supported by the left shaft support 34.

The right tilt shaft 43 protrudes rightward from the bracket body 41. The right tilt shaft 43 is inserted into the right support hole 37 of the right shaft support 35. The right tilt shaft 43 is rotatably supported by the right shaft support 35. The second bracket 22 is rotatably supported with respect to the first bracket 21 by the left tilt shaft 42 and the right tilt shaft 43.

The left tilt shaft 42 includes a first hole 47. The first hole 47 penetrates through the left tilt shaft 42 in the left-right direction. The right tilt shaft 43 includes a second hole 48. The second hole 48 penetrates the right tilt shaft 43 in the left-right direction. As shown in FIGS. 3 to 5, a left cover 51 and a right cover 52 are mounted on the second bracket 22. The left cover 51 is mounted on the left tilt shaft 42. The left cover 51 covers the first hole 47 from the left side. The right cover 52 is mounted on the right tilt shaft 43. The right cover 52 covers the second hole 48 from the right side.

Figure 8:
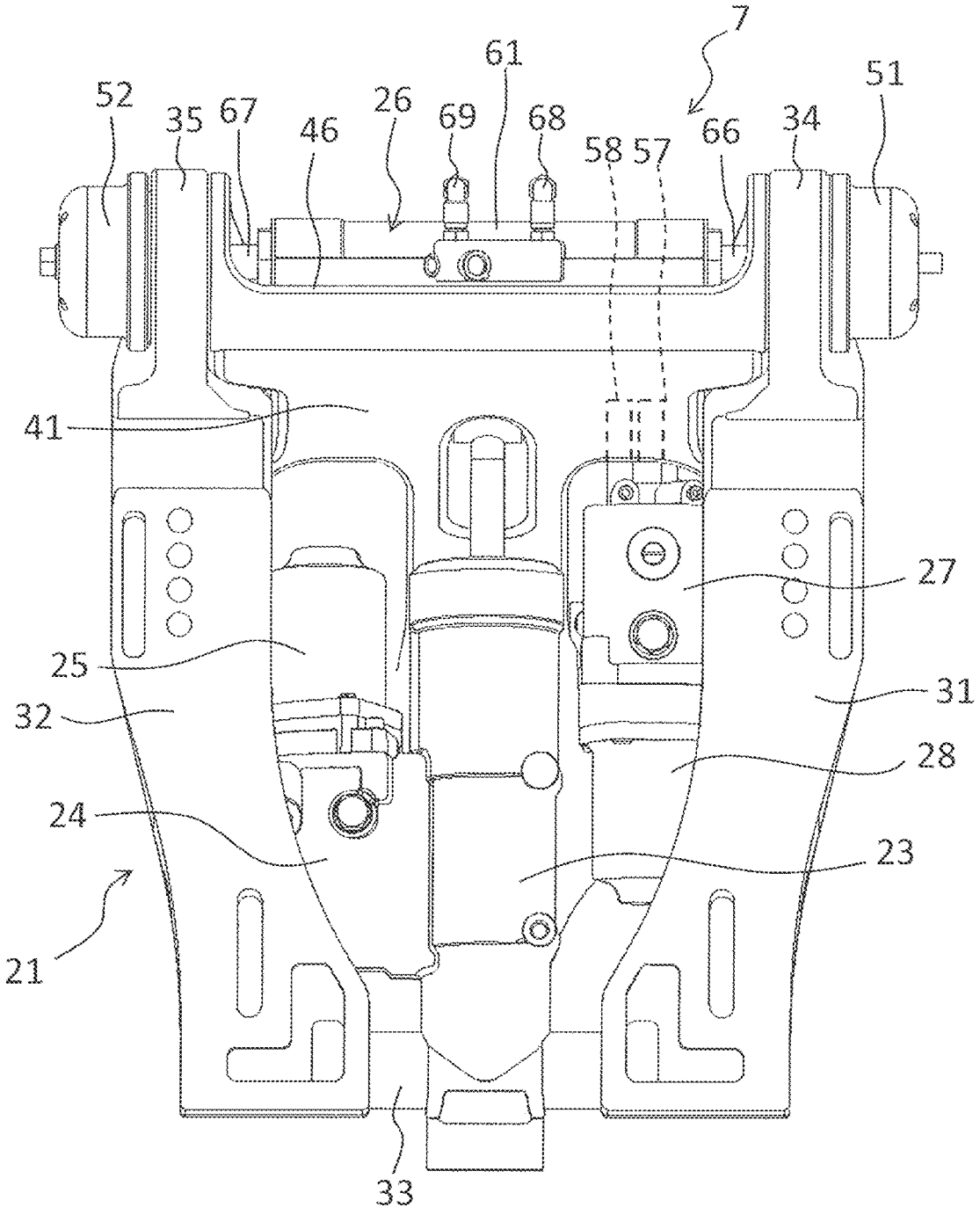
FIG. 8 is a front view of the system for maneuvering a boat.

FIG. 8 is a front view of the system 7. As shown in FIG. 4 and FIG. 8, the tilt cylinder 23, the tilt pump 24, and the tilt motor 25 are disposed between the left bracket 31 and the right bracket 32. The tilt cylinder 23, the tilt pump 24, and the tilt motor 25 are disposed in front of the second bracket 22. The lower end of the tilt cylinder 23 is attached to the connector 33. The upper end of the tilt cylinder 23 is attached to the second bracket 22.

The tilt pump 24 is connected to the tilt cylinder 23. The tilt motor 25 is connected to the tilt pump 24. The tilt pump 24 is driven by the tilt motor 25. The tilt cylinder 23 is, for example, a hydraulic cylinder. The tilt cylinder 23 expands and contracts by the hydraulic fluid from the tilt pump 24. Therefore, the second bracket 22 rotates about the right and left tilt shafts 42 and 43 with respect to the first bracket 21. As a result, the outboard motor 3 swings up and down around the tilt shafts 42 and 43.

The steering pump 27 and the steering motor 28 are disposed between the left bracket 31 and the right bracket 32. The steering pump 27 and the steering motor 28 are disposed in front of the second bracket 22. The steering motor 28 is connected to the steering pump 27. The steering pump 27 is driven by the steering motor 28. The steering pump 27 supplies hydraulic fluid to the steering cylinder 26. The steering pump 27 and the tilt pump 24 are spaced apart from each other in the left-right direction.

The steering pump 27 and/or the steering motor 28 are attached to the second bracket 22. More specifically, as shown in FIG. 5, the second bracket 22 includes an attachment portion 49. The steering pump 27 is attached to the attachment portion 49 via a stay 50. For example, the stay 40 is attached to the attachment portion 49 by a fixing member such as a screw.

Figure 9:
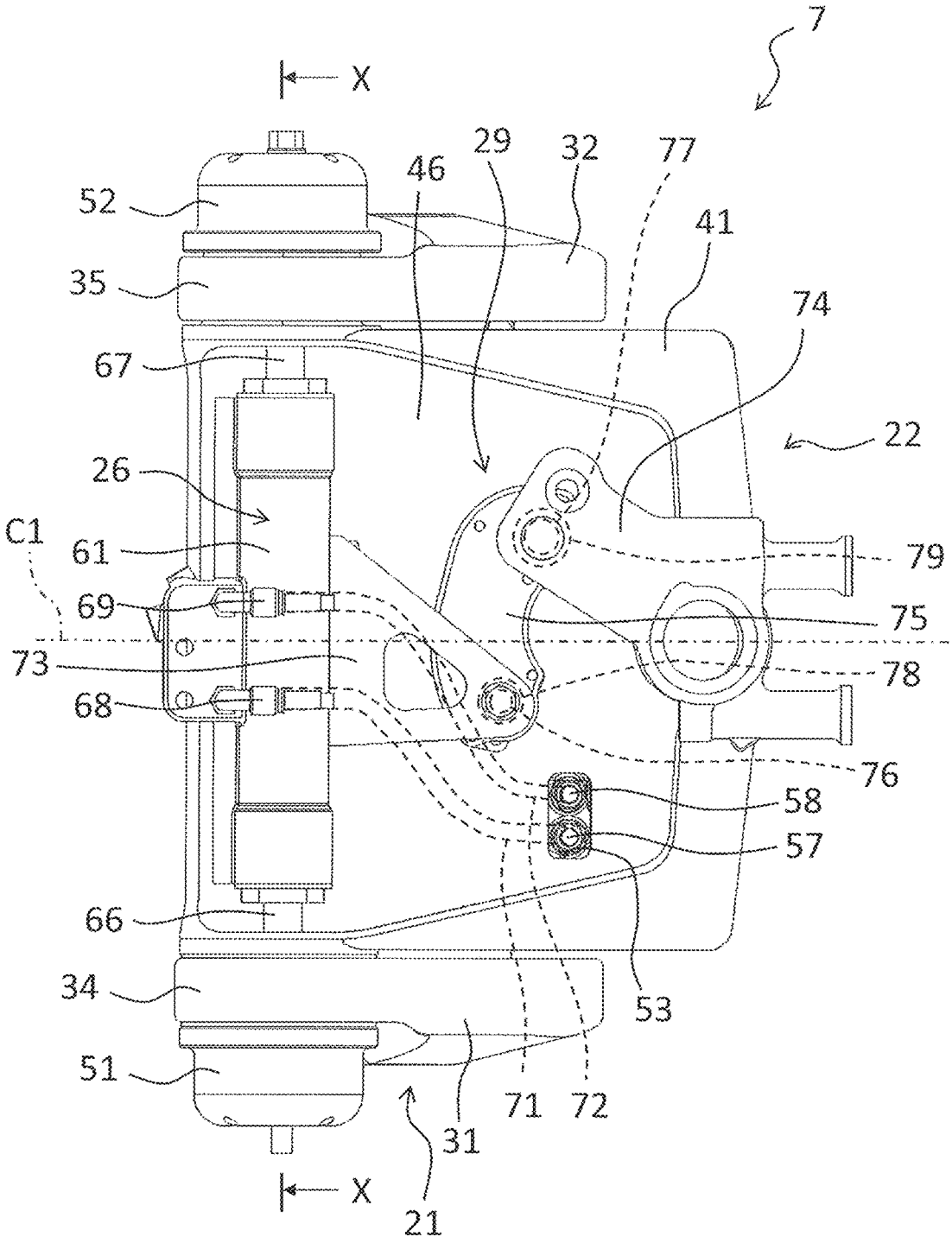
FIG. 9 is a top view of the system for maneuvering a boat.

As shown in FIG. 8, the steering pump 27 includes a first connection port 57 and a second connection port 58. The first connection port 57 and the second connection port 58 extend upward from the steering pump 27. FIG. 9 is a top view of the system 7. As shown in FIG. 9, the second bracket 22 includes an opening 53. The opening 53 penetrates the second bracket 22 in the vertical direction. The first connection port 57 and the second connection port 58 of the steering pump 27 are disposed to face the opening 53.

The steering cylinder 26 is disposed between the left tilt shaft 42 and the right tilt shaft 43. The steering cylinder 26 is disposed in the recess 46 of the second bracket 22. The tilt cylinder 23 is disposed between the steering pump 27 and the tilt pump 24. The steering cylinder 26 is driven by the hydraulic fluid from the steering pump 27. As a result, the steering cylinder 26 applies a steering force to the outboard motor 3 to rotate the outboard motor 3 about the steering shaft 19.

Figure 10:
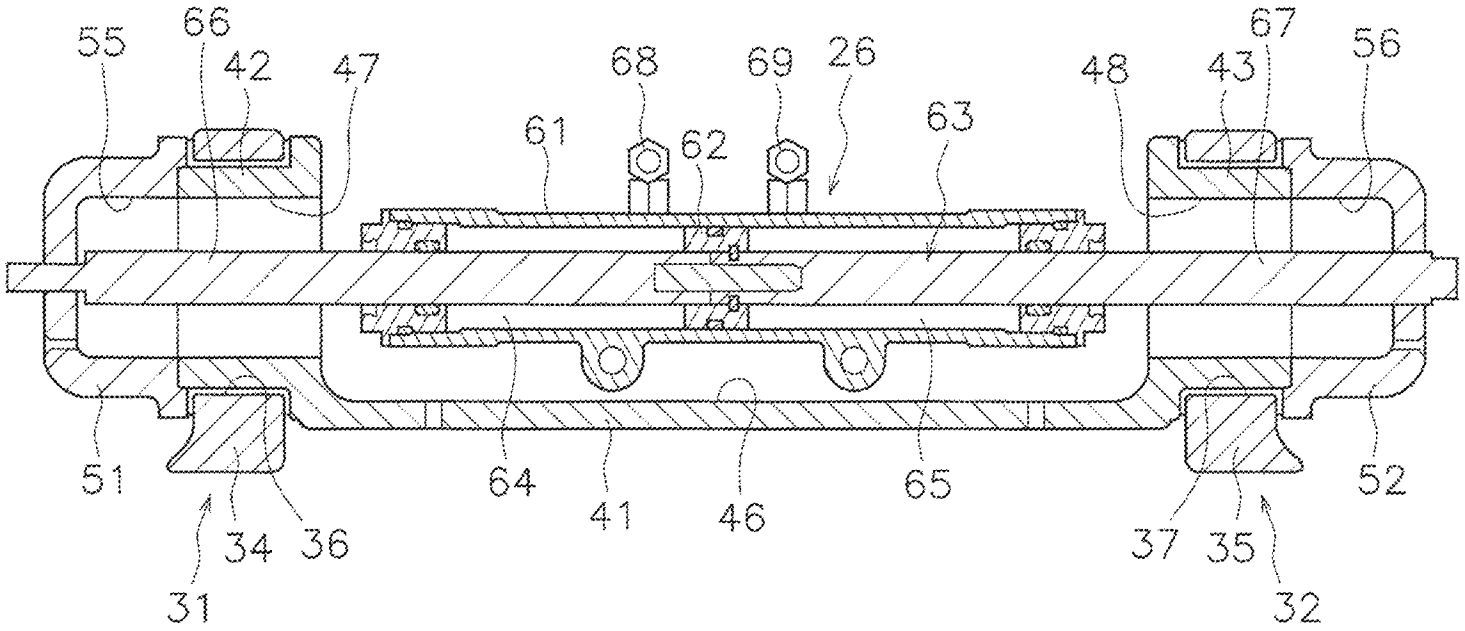
FIG. 10 is a cross-sectional view taken along line X-X in FIG. 9.

FIG. 10 is a cross-sectional view taken along line X-X in FIG. 9. As shown in FIG. 10, the steering cylinder 26 includes a cylindrical tube 61, a piston 62, and a rod 63. The piston 62 is disposed in the cylindrical tube 61. The piston 62 partitions the space in the cylindrical tube 61 into a left chamber 64 and a right chamber 65. The rod 63 is connected to the piston 62.

The rod 63 includes a left rod portion 66 and a right rod portion 67. The left rod portion 66 is supported by the left cover 51. The left cover 51 includes a left recess 55. A portion of the left rod portion 66 is disposed in the first hole 47 and the left recess 55. The right rod portion 67 is supported on the right cover 52. The right rod portion 67 includes a right recess 56. A portion of the right rod portion 67 is disposed in the second hole 48 and the right recess 56.

The steering cylinder 26 includes a first connection port 68 and a second connection port 69. The first connection port 68 is located closer to the center of the cylindrical tube 61 in the axial direction than the left end of the cylindrical tube 61. The second connection port 69 is located closer to the center of the cylindrical tube 61 in the axial direction than the right end of the cylindrical tube 61. As shown in FIG. 9, the first connection port 68 and the second connection port 69 are bent rearward from a position located forward of the cylindrical tube 61. The first connection port 68 and the second connection port 69 overlap with the steering cylinder 26 in a plan view of the system 7.

The steering cylinder 26 is connected to the steering pump 27 through a first hydraulic pipe 71 and a second hydraulic pipe 72. The first connection port 68 of the steering cylinder 26 is connected to the first connection port 57 of the steering pump 27 through the first hydraulic pipe 71. The second connection port 69 of the steering cylinder 26 is connected to the second connection port 58 of the steering pump 27 through the second hydraulic pipe 72. The first hydraulic pipe 71 and the second hydraulic pipe 72 extend rearwardly from a location overlapping with the steering cylinder 26 in the plan view of the maneuvering system 7.

Figure 11A:
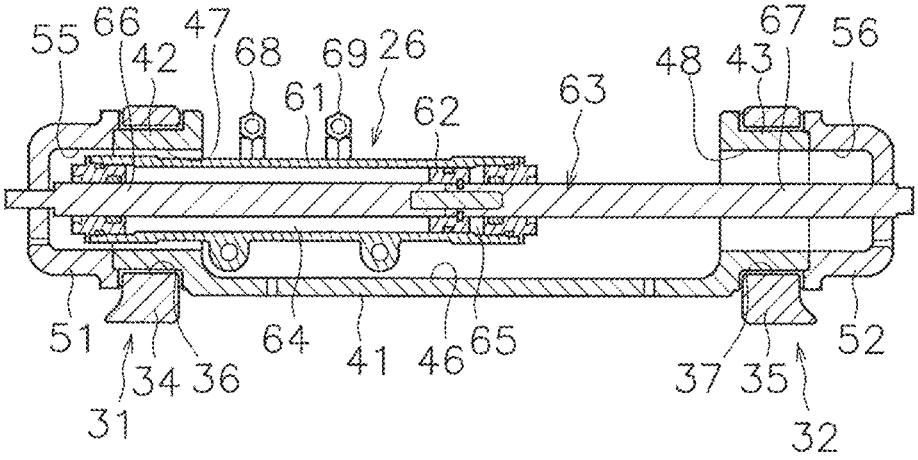
FIG. 11A is a diagram showing a stroke range of a steering cylinder.
Figure 11B:
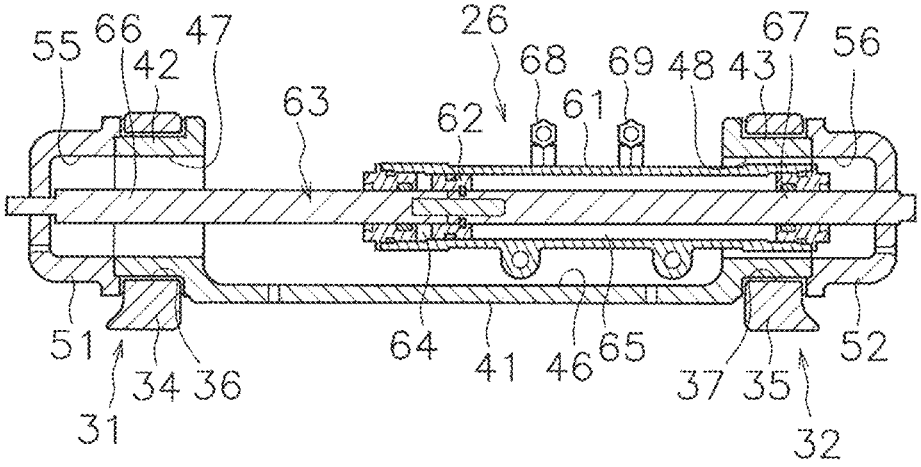
FIG. 11B is a diagram showing a stroke range of the steering cylinder.

As shown in FIG. 11A, hydraulic fluid is supplied to the left chamber 64, and hydraulic fluid is discharged from the right chamber 65 such that the cylindrical tube 61 moves leftward. A portion of the stroke range of the cylindrical tube 61 is located in the first hole 47 of the left tilt shaft 42. A portion of the stroke range of the cylindrical tube 61 is located in the left recess 55 of the left cover 51. As shown in FIG. 11B, hydraulic fluid is supplied to the right chamber 65, and hydraulic fluid is discharged from the left chamber 64 such that the cylindrical tube 61 moves rightward. A portion of the stroke range of the cylindrical tube 61 is located in the second hole 48 of the right tilt shaft 43. A portion of the stroke range of the cylindrical tube 61 is located in the right recess 56 of the right cover 52.

The linkage 29 connects the outboard motor 3 and the steering cylinder 26. As shown in FIG. 9, the linkage 29 includes a first member 73, a second member 74, and a third member 75. The first member 73 is coupled to the steering cylinder 26. The second member 74 is connected to the outboard motor 3. The third member 75 is connected to the first member 73 and the second member 74.

Specifically, the third member 75 includes a first connecting shaft 76 and a second connecting shaft 77. The third member 75 is rotatably connected to the first member 73 at the first connecting shaft 76. The third member 75 is rotatably connected to the second member 74 at the second connecting shaft 77. The first connecting shaft 76 and the second connecting shaft 77 are eccentrically disposed in the left-right direction with respect to the center line C1 of the second bracket 22 extending in the front-rear direction.

The linkage 29 is provided with a first sensor 78 and a second sensor 79. The first sensor 78 is provided on the first connecting shaft 76. The first sensor 78 detects a first rotation angle. The first rotation angle is a rotation angle of the third member 75 with respect to the first member 73. The second sensor 79 is provided on the second connecting shaft 77. The second sensor 79 detects a second rotation angle. The second rotation angle is a rotation angle of the third member 75 with respect to the second member 74.

As shown in FIG. 1, the boat 1 includes a controller 81. The controller 81 includes a processor such as a CPU, and a memory such as a RAM and a ROM. The controller 81 controls the operation of the steering cylinder 26 by controlling the steering motor 28. Thus, the steering angle of the outboard motor 3 is controlled. The controller 81 receives a signal indicative of the first rotation angle from the first sensor 78. The controller 81 receives a signal indicative of the second rotation angle from the second sensor 79. The controller 81 acquires the steering angle of the outboard motor 3 from the first rotation angle and the second rotation angle. In FIG. 1, the controller 81 is disposed at the maneuvering seat 4, but may be disposed in another location.

The controller 81 receives a signal indicative of an operation angle of the steering member 5 from the steering member 5. The controller 81 controls the steering motor 28 so that the steering angle of the outboard motor 3 coincides with the target steering angle corresponding to the operation angle of the steering member 5. When one of the first sensor 78 and the second sensor 79 fails, the controller 81 may acquire the steering angle of the outboard motor 3 based on a signal from the other sensor which has not failed.

In the system 7 according to the preferred embodiments described above, the steering cylinder 26 is disposed between the left tilt shaft 42 and the right tilt shaft 43. Thus, the system 7 is reduced in size. A portion of the stroke range of the steering cylinder 26 is located in the first hole 47 of the left tilt shaft 42 and the second hole 48 of the right tilt shaft 43. Therefore, it is possible to secure a large stroke range of the steering cylinder 26 while downsizing the system 7.

Although preferred embodiments of the present invention have been described above, the present invention is not limited to the above preferred embodiments, and various modifications are possible without departing from the gist of the invention.

The configuration of the boat 1 may be varied. The configuration of the outboard motor 3 may be varied. The configuration of the system 7 may be changed. For example, the configuration of the first bracket 21 may be varied. The configuration of the second bracket 22 may be varied. The configuration of the steering cylinder 26 may be varied. For example, the arrangement of the first connection port 68 and the second connection port 69 may be changed.

The steering pump 27 and/or the steering motor 28 may be mounted on the first bracket 21. The steering pump 27 and/or the steering motor 28 may be disposed outside the first bracket 21 and the second bracket 22. The steering pump 27 and the steering motor 28 may be retrofitted to an existing bracket. The steering pump 27 and the steering motor 28 may be omitted. The steering cylinder 26 may be driven by a manually operated pump.

A portion of the stroke range of the steering cylinder 26 may be disposed only in the first hole 47 of the first hole 47 and the second hole 48. The first hole 47 may be provided in the right tilt shaft 43. The second hole 48 may be provided in the left tilt shaft 42.

The configuration of the first hydraulic pipe 71 and the second hydraulic pipe 72 may be varied. For example, the first hydraulic pipe 71 and the second hydraulic pipe 72 may be disposed so as to extend under the steering cylinder 26. The first hydraulic pipe 71 and the second hydraulic pipe 72 may be disposed so as to extend from the front to the rear of the steering cylinder 26 and return to the front. The first hydraulic pipe 71 and the second hydraulic pipe 72 may be disposed so as to extend from the rear to the front of the steering cylinder 26. The first hydraulic pipe 71 and the second hydraulic pipe 72 may be disposed so as to extend from the rear to the front of the steering cylinder 26.

The configuration of the linkage 29 may be varied. For example, one or both of the first connecting shaft 76 and the second connecting shaft 77 may be disposed on the center line C1 of the second bracket 22 extending in the front-rear direction. The third member 75 may be omitted, and the first member 73 and the second member 74 may be connected by a connecting shaft.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for maneuvering a boat including a hull and an outboard motor attached to the hull, the system comprising:

a first bracket attachable to the hull;

a second bracket including a left tilt shaft, a right tilt shaft, and a steering shaft support, to support the outboard motor at the steering shaft support and being rotatably supported with respect to the first bracket at the left tilt shaft and the right tilt shaft;

a hydraulic cylinder to exert a steering force on the outboard motor to rotate the outboard motor about the steering shaft support, at least a portion of the hydraulic cylinder being located between the left tilt shaft and the right tilt shaft; and a hydraulic pump to supply hydraulic fluid to the hydraulic cylinder; wherein one of the left tilt shaft and the right tilt shaft includes a first hole; and a portion of a stroke range of the hydraulic cylinder is located within the first hole.

2. The system according to claim 1, wherein the other of the left tilt shaft and the right tilt shaft includes a second hole; and a portion of the stroke range of the hydraulic cylinder is located within the second hole.

3. The system according to claim 1, wherein the second bracket further includes an attachment portion to which the hydraulic pump is attached.

4. The system according to claim 1, wherein the hydraulic cylinder includes a first connection port and a second connection port to which a hydraulic pipe is connected.

5. The system according to claim 4, wherein the hydraulic cylinder includes a cylindrical tube;

the first connection port is closer to a center of the cylindrical tube in an axial direction of the cylindrical tube than a left end of the cylindrical tube; and the second connection port is located closer to the center of the cylindrical tube in the axial direction than a right end of the cylindrical tube.

6. The system according to claim 4, wherein the first connection port and the second connection port are bent rearward from a location forward of the cylindrical tube.

7. The system according to claim 1, further comprising:

a hydraulic pipe connected to the hydraulic cylinder and the hydraulic pump; and the hydraulic pipe extends rearward from a location overlapping with the hydraulic cylinder in a plan view of the system.

8. The system of claim 1, further comprising:

a linkage including a connecting shaft to connect the outboard motor and the hydraulic cylinder at the connecting shaft; and a sensor provided on the connecting shaft to detect a steering angle of the outboard motor.

9. The system according to claim 1, further comprising:

a linkage to connect the outboard motor and the hydraulic cylinder;

a first sensor; and a second sensor; wherein the linkage includes:

a first member connected to the hydraulic cylinder;

a second member connected to the outboard motor; and a third member including a first connecting shaft and a second connecting shaft, the third member being connected to the first member at the first connecting shaft and connected to the second member at the second connecting shaft;

the first sensor is provided on the first connecting shaft to detect a rotation angle of the third member with respect to the first member; and the second sensor is provided on the second connecting shaft to detect a rotation angle of the third member with respect to the second member.

10. The system according to claim 9, wherein at least one of the first connecting shaft and the second connecting shaft is arranged eccentrically in a left-right direction of the system with respect to a center line of the second bracket extending in a front-rear direction of the system.

11. The system according to claim 1, wherein the hydraulic pump is attached to the second bracket.

12. The system according to claim 1, further comprising:

a tilt cylinder to rotate the outboard motor about the left tilt shaft and the right tilt shaft; and a tilt pump to supply hydraulic fluid to the tilt cylinder; wherein the hydraulic pump is attached to the first bracket or the second bracket;

the hydraulic pump and the tilt pump are spaced apart from each other in a left-right direction of the system; and the tilt cylinder is between the hydraulic pump and the tilt pump.

* * * * *